US009501013B2

(12) United States Patent
Lee et al.

(10) Patent No.: US 9,501,013 B2
(45) Date of Patent: Nov. 22, 2016

(54) HEATING MEMBER AND FUSING APPARATUS INCLUDING THE SAME

(71) Applicant: Samsung Electronics Co., Ltd., Suwon-Si, Gyeonggi-Do (KR)

(72) Inventors: Sang-eui Lee, Yongin-si (KR); Dong-earn Kim, Seoul (KR); Dong-ouk Kim, Pyeongtaek-si (KR); Ha-jin Kim, Suwon-si (KR); Sung-hoon Park, Seoul (KR); Min-jong Bae, Yongin-si (KR); Yoon-chul Son, Hwaseong-si (KR); Kun-mo Chu, Seoul (KR); In-Taek Han, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 111 days.

(21) Appl. No.: 13/889,443

(22) Filed: May 8, 2013

(65) Prior Publication Data

US 2013/0302074 A1 Nov. 14, 2013

(30) Foreign Application Priority Data

May 8, 2012 (KR) ..... 10-2012-0048825
Sep. 5, 2012 (KR) ..... 10-2012-0098419

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/206
USPC ..... 399/333
See application file for complete search history.

(56) References Cited

U.S. PATENT DOCUMENTS 5,966,578 A 10/1999 Soutome et al.
2006/0157464 A1* 7/2006 Omata et al. ..... 219/216
2009/0016786 A1* 1/2009 Suzuki ..... G03G 15/161 399/307
2009/0206974 A1* 8/2009 Meinke ..... H01F 5/00 336/224
2009/0285611 A1 11/2009 Omata et al.
2010/0260526 A1* 10/2010 Lee ..... G03G 15/2053 399/333
2011/0013954 A1 1/2011 Domoto et al.
(Continued)

FOREIGN PATENT DOCUMENTS

EP 2278415 A1 1/2011
JP 2000-058228 A 2/2000
(Continued)

OTHER PUBLICATIONS

European Search Report dated Dec. 2, 2013 for corresponding European Application No. 13166833.7.
(Continued)

*Primary Examiner* — Walter L Lindsay, Jr.
*Assistant Examiner* — Philip Marcus T Fadul
(74) *Attorney, Agent, or Firm* — NSIP Law

(57) ABSTRACT

A heating member for a fusing apparatus includes a resistive heating layer including a base polymer and an electroconductive filler dispersed in the base polymer, where the resistive heating layer generates heat by receiving electric energy, and where a storage modulus of the resistive heating layer is about 1.0 megapascal or greater.

21 Claims, 7 Drawing Sheets

(56) References Cited

U.S. PATENT DOCUMENTS

| | | | | |
|---|---|---|---|---|
| 2011/0013955 | A1* | 1/2011 | Choi | G03G 15/2053 399/333 |
| 2011/0116849 | A1 | 5/2011 | Qi et al. | |
| 2011/0116850 | A1 | 5/2011 | Lee et al. | |
| 2011/0150545 | A1* | 6/2011 | Nihonyanagi et al. | 399/329 |
| 2012/0070208 | A1 | 3/2012 | Qi et al. | |
| 2014/0038811 | A1* | 2/2014 | Murakami et al. | 502/158 |

FOREIGN PATENT DOCUMENTS

| | | | |
|---|---|---|---|
| JP | 2000321908 | A | 11/2000 |
| JP | 2007179009 | A | 7/2007 |
| JP | 2007272223 | B2 | 10/2007 |
| JP | 2008158053 | A | 7/2008 |

OTHER PUBLICATIONS

Fu, et al., "Vibration Reduction Ability of Polymers, Particularly Polymethylmethacrylate and Polytetrafluoroethylene," *Polymers & Polymer Composites*, vol. 9, No. 6, 2001. pp. 423-425.

* cited by examiner

HEATING MEMBER AND FUSING APPARATUS INCLUDING THE SAME

CROSS-REFERENCE TO RELATED APPLICATIONS

This application claims priority to Korean Patent Application No. 10-2012-0048825, filed on May 8, 2012, and Korean Patent Application No. 10-2012-0098419, filed on Sep. 5, 2012, and all the benefits accruing therefrom under 35 U.S.C. §119, the contents of which in their entireties are herein incorporated by reference.

BACKGROUND

1. Field

The disclosure relates to a heating member using a resistive heater, and a fusing apparatus including the heating member.

2. Description of the Related Art

In an electrophotographic imaging apparatus, an electrostatic latent image formed on an image receptor is supplied with toner to form a visible toner image on the image receptor. After transfer of the toner image onto a recording medium, the toner image is fused onto the recording medium. The toner may be prepared by addition of a variety of functional additives, including a coloring agent, into a base resin. The fusing of the toner image involves applying heat and pressure. Energy used in the fusing process makes up most of a total amount of energy used in the electrophotographic imaging apparatus.

In general, a fusing apparatus includes a heat roller and a press roller engaged with each other to form a fusing nip. The heat roller is heated by a heat source, such as a halogen lamp. While the recording medium with the transferred toner image passes through the fusing nip, heat and pressure are applied to the toner image. In such a fusing apparatus, heat is sequentially transferred from the heat source to the toner via the heat roller and the recording medium.

SUMMARY

Provided are heating members with rapid heating capability and ensured durability, and fusing apparatuses including the heating members.

Additional aspects will be set forth in part in the description which follows and, in part, will be apparent from the description, or may be learned by practice of the presented embodiments.

According to an embodiment of the invention, a heating member for a fusing apparatus includes a resistive heating layer including a base polymer and an electroconductive filler dispersed in the base polymer, where the resistive heating layer generates heat by receiving electric energy, and where a storage modulus of the resistive heating layer is about 1.0 megapascal (MPa) or greater.

In an embodiment, a tangent loss rate of the resistive heating layer may be about 0.2 or less.

In an embodiment, the storage modulus of the resistive heating layer may be about 1.0 MPa or greater at a temperature of about 120° C. or greater, and a tangent loss rate of the resistive heating layer may be about 0.2 or less at a temperature of about 120° C. or greater.

In an embodiment, the base polymer may include at least one of silicon, polyimide, polyimideamide and fluoropolymer.

In an embodiment, the electroconductive filler may include a carbonaceous filler. The carbonaceous filler may include at least one of carbon nanotube (CNT), carbon black, carbon nanofiber, graphene, expanded graphite, graphite nanoplatelet and graphite oxide. The electroconductive filler may include CNT at an amount of about 4 parts per hundred resin (phr) or greater. A length of the CNT may be about 10 micrometers (μm) or greater.

In an embodiment, the heating member may further include a hollow pipe-shaped support which supports the resistive heating layer. In an alternative embodiment, the heating member may further include a belt-shaped support which supports the resistive heating layer.

In an embodiment, a resistance change rate of the resistive heating layer may be expressed by $[(R_F-R_0)/R_0]\times100$ percent, where $R_0$ denotes a resistance of the resistive heating layer at room temperature, and $R_F$ denotes a resistance of the resistive heating layer at a fusing temperature, and the resistance change rate of the resistive heating layer may be about 100 percent or less.

According to another embodiment of the invention, a fusing apparatus includes: the heating member; and a press member disposed opposite to the heating member, where the heating member and the press member define a fusing nip.

BRIEF DESCRIPTION OF THE DRAWINGS

These and/or other features will become apparent and more readily appreciated from the following description of the embodiments, taken in conjunction with the accompanying drawings, in which.

DETAILED DESCRIPTION

Figure 1:
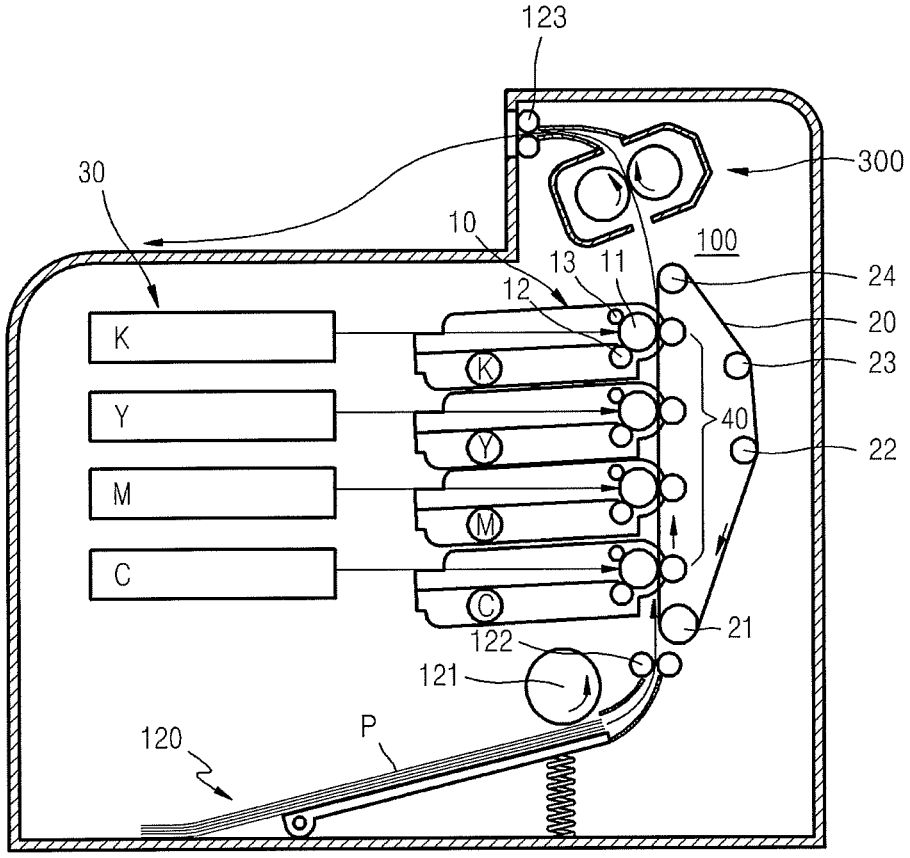
FIG. 1 is a schematic cross sectional view of an embodiment of an electrophotographic imaging apparatus including a heating member and a fusing apparatus according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, embodiments of the a heating member and a fusing apparatus according to the invention will be described in further detail with reference to the accompanying drawings.

FIG. 1 is a schematic cross-sectional view showing a structure of an embodiment of an electrophotographic imaging apparatus including a heating member and a fusing apparatus 300, according to the invention. Referring to FIG. 1, the electrophotographic imaging apparatus includes a printing unit 100 for printing an image on a recording medium through electrophotographic processes, and the fusing apparatus 300. In an embodiment, as shown in FIG. 1, the electrophotographic imaging apparatus may be a dry-type color imaging apparatus, which prints a color image using a dry developer (hereinafter, referred to as "toner").

The printing unit 100 includes an exposing unit 30, a developing unit 10 and a transfer unit. The printing unit 100 may include a plurality of developing units 10, e.g., four developing units 10C, 10M, 10Y and 10K, that respectively accommodate toner of different colors, e.g., colors of cyan ("C"), magenta ("M"), yellow ("Y") and black ("K"), and a plurality of exposing units 30, e.g., four exposing units 30C, 30M, 30Y and 30K, which correspond to the developing units 10C, 10M, 10Y and 10K, respectively.

Each of the developing units 10C, 10M, 10Y and 10K includes a photoconductive drum 11 as an image receiver, on which an electrostatic latent image is formed, and a developing roller 12 for developing the electrostatic latent image. A charging bias voltage is applied to a charging roller 13 to charge an outer circumferential surface of the photoconductive drum 11 to a uniform potential. In an alternative embodiment, a corona charger (not shown) may be included instead of the charging roller 12. The developing roller 12 attaches the toner on an outer circumferential surface thereof, and supplies toner to the photoconductive drum 11. A developing bias voltage for supplying toner to the photoconductive drum 11 is applied to the developing roller 12. In an alternative embodiment, each of the developing units 10C, 10M, 10Y and 10K may further include a supplying roller (not shown), which attaches toner therein to the developing roller 12, a regulating member (not shown), which regulates an amount of toner adhered to the developing roller 12, and an agitator (not shown), which transfers toner therein to the supplying roller and/or the developing roller 12. In an embodiment, each of the developing units 10C, 10M, 10Y and 10K may include a cleaning blade (not shown) which removes toner adhered to, the outer circumference surface of the photoconductive drum 11 before the photoconductive drum 11 is charged, and a space (not shown) which receives the removed toner.

In an embodiment, the transfer unit may include a recording medium conveyer belt 20 and a plurality of transfer rollers 40, e.g., four transfer rollers 40. The recording medium conveyer belt 20 is disposed opposite to, e.g., facing, outer circumferential surfaces of the photoconductive drums 11 exposed outside of the developing units 10C, 10M, 10Y and 10K. The recording medium conveyer belt 20 is supported by a plurality of support rollers 21, 22, 23 and 24, and loops. The recording medium conveyer belt 20 may be installed substantially in a vertical direction. The transfer rollers 40 are disposed opposite to, e.g., facing, the photoconductive drums 11 of the developing units 10C, 10M, 10Y and 10K, respectively, and the recording medium conveyer belt 20 disposed between the transfer rollers 40 and the developing units 10C, 10M, 10Y and 10K. A transfer bias voltage is applied to the transfer rollers 40. Exposing units 30C, 30M, 30Y and 30K scan light corresponding to information of images in colors C, M, Y and K onto the photoconductive drums 11 of the developing units 10C, 10M, 10Y and 10K, respectively. In an embodiment, each of the exposing units 30C, 30M, 30Y and 30K may be a laser scanning unit ("LSI") including a laser diode as a light source.

An embodiment of a method of forming a color image using the electrophotographic imaging apparatus having the above configuration will now be described.

In such an embodiment, the photoconductive drum 11 of each of the developing units 10C, 10M, 10Y and 10K is charged to a substantially uniform potential by a charging bias voltage applied to the charging roller 13. The exposing units 30C, 30M, 30Y and 30K scan light corresponding to the information of the images in C, M, Y, K onto the corresponding photoconductive drums 11 of the developing units 10C, 10M, 10Y and 10K to form electrostatic latent images. When a developing bias voltage is applied to each of the developing rollers 12, toner adhered to the outer circumferences of the developing rollers 12 is transferred onto the electrostatic latent images, thereby forming toner images in C, M, Y and K on the photoconductive drums 11 of the developing units 10C, 10M, 10Y and 10K.

A final toner receiving medium, for example, a recording medium P, is transferred from, e.g., drawn out of, a cassette 120 by a pickup roller 121, and is then moved onto the recording medium conveyer belt 20 by a feed roller 122. The recording medium P is adhered to a surface of the recording medium conveyer belt 20 by an electrostatic force, and moved at a speed substantially the same as a traveling speed of the recording medium conveyer belt 20.

In one embodiment, for example, a leading end of the recording medium P may reach a transfer nip, which is defined by the photoconductive drum 11 of the developing unit 10C and the corresponding transfer roller 40, at the same time as when a leading end of the C toner image on the outer circumference of the photoconductive drum 11 of the developing unit 10C reaches the transfer nip. When a transfer bias voltage is applied to the transfer roller 40, the toner image on the photoconductive drum 11 is transferred onto the recording medium P. As the recording medium P is moved, the M, Y and K toner images on the corresponding photoconductive drums 11 of the developing units 10M, 10Y and 10K are sequentially transferred and overlaps each other onto the recording medium P, such that a color toner image is provided on the recording medium P.

In an embodiment, the color toner image transferred on the recording medium P remains on the surface of the recording medium P by an electrostatic force. The fusing apparatus 300 fixes the color toner image to the recording medium P using heat and pressure. The recording medium P, to which the color toner image is fixed, is discharged out of the electrophotographic imaging apparatus by a discharge roller 123.

In such an embodiment, the fusing apparatus 300 may be heated to a predetermined fusing temperature to fix a toner image. The shorter the heating time, the shorter the time that it takes for a first page to be printed out after a printing instruction is received. The fusing apparatus 300 may be heated only for printing and not operate in a standby mode such that it takes time for the fusing apparatus 300 to be heated again when printing is restarted. The fusing apparatus 300 may be controlled to maintain a predetermined temperature in the standby mode such that the heating time taken after printing is restarted is substantially reduced. The preheating temperature of the fusing apparatus 200 in the standby mode may be in a range from about 120° C. to about 180° C. When it takes a relatively short time to heat the fusing apparatus 300 to a printable temperature, preheating may not be performed in the standby mode, thus substantially reducing energy consumption by the fusing apparatus 300 and time for printing a first page.

Figure 2:
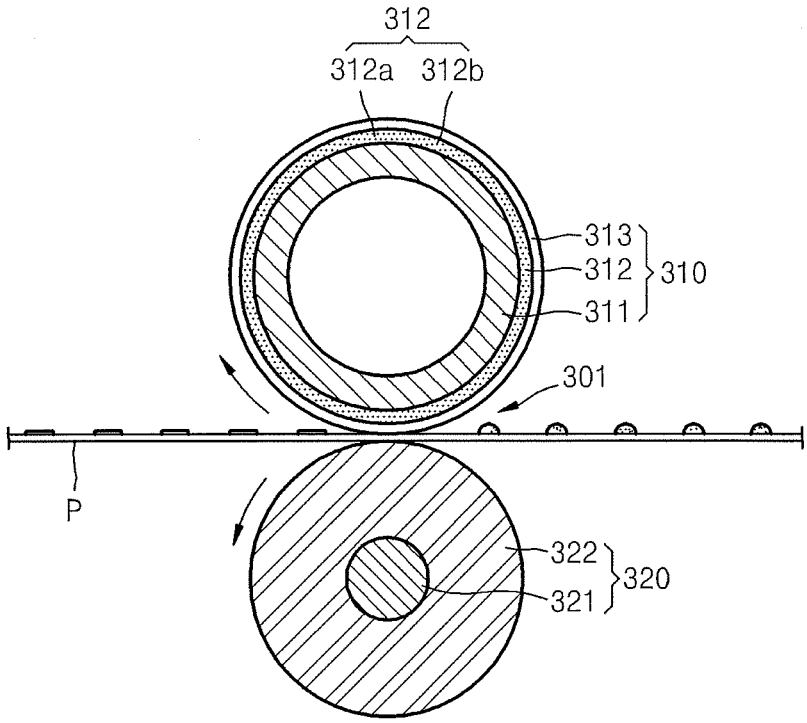
FIG. 2 is a schematic cross-sectional view of an embodiment of a roller-type fusing apparatus according to the invention.
Figure 3:
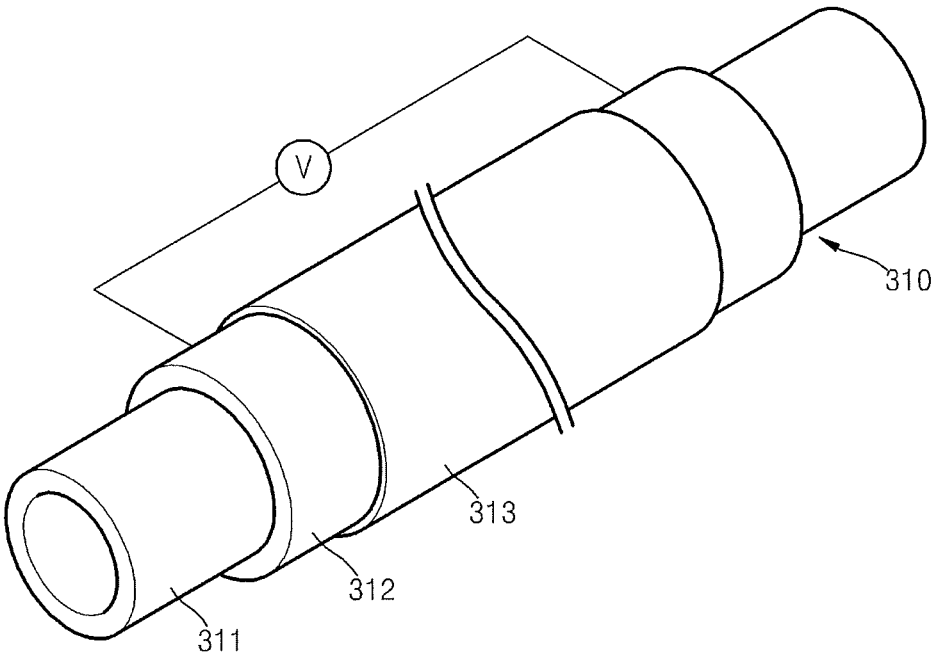
FIG. 3 is a perspective view of an embodiment of a heating member in the roller-type fusing apparatus of FIG. 2, according to the invention.

FIG. 2 is a schematic cross-sectional view showing a structure of an embodiment of a fusing apparatus according to the invention. FIG. 3 is a perspective view of an embodiment of a roller or hollow cylindrical shape heating member in the fusing apparatus of FIG. 2, according to the invention. In an embodiment, as shown in FIG. 2, the fusing apparatus may be a roller-type including the roller or hollow cylindrical shape heating member 310.

Referring to FIGS. 2 and 3, the roller or hollow cylindrical shape heating member 310 and a press member 320 are disposed opposite to each other, and thereby collectively define a fusing nip 301. In such an embodiment, the press member 320 may have a roller shape and include an elastic layer 322 on a metal support 321. The heating member 310 and the press member 320 are biased to engage with each other by a bias member (not shown), for example, by a spring. In such an embodiment, the elastic layer 322 of the press member 320 is partially deformed, and the fusing nip 301 for thermal transfer from the heating member 310 to the toner is thereby provided.

The heating member 310 may include a resistive heating layer 312, a support 311 that supports the resistive heating layer 312, and a release layer 313. In an embodiment, the support 311 has a hollow pipe shape, and the heating member 310 may have a roller or hollow cylindrical shape. A heating member having the roller or hollow cylindrical shape and included in a fusing apparatus of an electrophotographic imaging apparatus may be referred to as a fusing roller.

Figure 4:
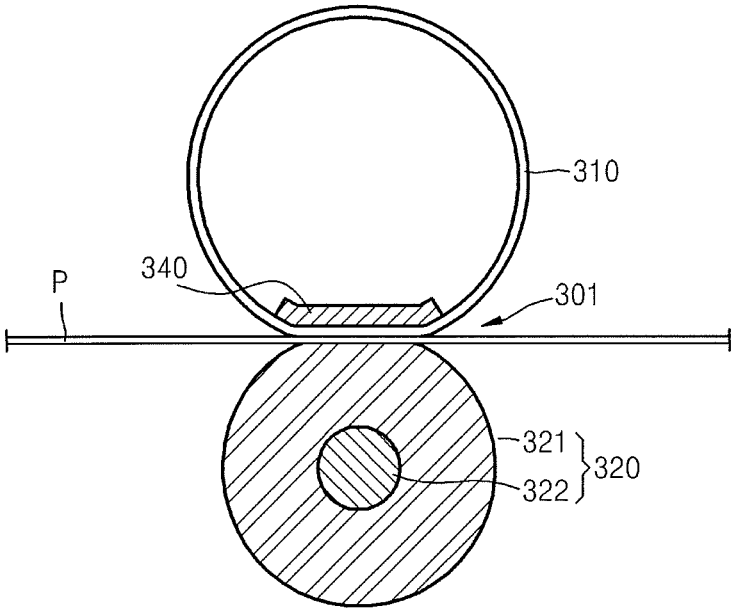
FIG. 4 is a schematic cross-sectional view of an embodiment of a belt-type fusing apparatus according to the invention.

FIG. 4 is a schematic cross-sectional view of an alternative embodiment of a fusing apparatus according to the invention. In an embodiment, as shown in FIG. 4, the fusing apparatus includes a heating member 310 including a belt-shaped support 311 (shown in FIG. 5). A heating member having a belt-like shape as shown in FIG. 4 and included in a fusing apparatus may be referred to as a fusing belt. In an embodiment, as shown in FIG. 4, the fusing apparatus includes the heating member 310, the press member 320 and a nip forming member 340. The nip forming member 340 may be disposed inside the belt-shaped heating member 310 having a shape of a closed loop. The press member 320 may be disposed outside the heating member 310. The press member 320 is disposed opposite to the nip forming member 340 with the heating member 310 therebetween and rotates, thereby defining a fusing nip 301. An elastic force may be applied by a bias unit (not shown) to the nip forming member 340 and/or the press member 320 in a direction, in which the nip forming member 340 and the press member 320 are pressed against each other.

Figure 5:
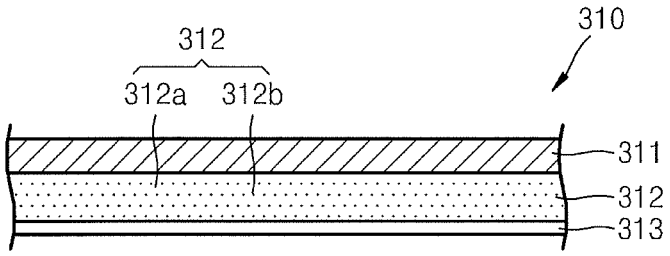
FIG. 5 is a partial cross-sectional view of an embodiment of a heating member in the belt-type fusing apparatus of FIG. 4.

FIG. 5 is a partial cross-sectional view of an embodiment of a heating member in the belt-type fusing apparatus of FIG. 4.

Referring to FIG. 5, the heating member 310 may include the support 311, the resistive heating layer 312 disposed on an external surface of the support 311, and the release layer 313. The support 311 may have sufficient flexibility for free deformation of the heating member 310 at the fusing nip 301 and for recovery to an original state after coming out of the fusing nip 301.

In an embodiment, the nip forming member 340 may be pressed toward the press member 320. In an embodiment, the nip forming member 340 may have an elastic roller shape, and may rotate together with the press member 320 such that the heating member 310 rotates.

Hereinafter, embodiments of the heating member 310 will be described.

In an embodiment, the support 311 may include a material, e.g., a polymer material, such as polyimide, polyimideamide and fluoropolymers, or a metallic material. In one embodiment, the support 311 includes at least one of fluoropolymers, e.g., fluorinated polyetheretherketone ("PEEK"), polytetrafluoroethylene ("PTFE"), perfluoroalkoxy ("PFA") and fluorinated ethylene propylene ("FEP"). In one embodiment, the support 311 may include at least one of metallic materials, e.g., stainless steel, nickel, copper and brass. In one embodiment, the support 311 includes a conductive metallic material, and an insulating layer (not shown) may be disposed between the support 311 and the resistive heating layer 312.

In an embodiment, the resistive heating layer 312 may include a base polymer 312*a* and an electroconductive filler 312*b* dispersed in the base polymer 312*a*. In such an embodiment, the base polymer 312*a* may include at least one of a variety of materials having thermal resistance at a fusing temperature. In one embodiment, the base polymer 312*a* may be high-thermal durable polymers, such as silicon-based polymer, polyimide, polyamide, polyimideamide and fluoropolymers, for example. In one embodiment, for example, fluoropolymers may be perfluoroelastomer, such as PFA, PTFE, or the like, and fluorinated polymer, such as PEEK, and FEP. In an embodiment, the resistive heating layer 312 may be elastic. A hardness of the base polymer 312*a* may be adjustable based on a target elasticity of the resistive heating layer 312. The base polymer 312*a* may include at least one of the above-listed polymers. In one embodiment, for example, the base polymer 312*a* may be one of the above-listed polymers, or a blend or a copolymer of at least two of the above-listed polymers.

In an embodiment, the electroconductive filler 312*b* may include one kind of electroconductive filler. In an alternative embodiment, the electroconductive filler 312*b* may include at least two kinds of electroconductive fillers dispersed in the base polymer 312*a*. In one embodiment, for example, the electroconductive filler 312*b* may include a metallic filler and a carbonaceous filler. In such an embodiment, the metallic filler may be metal particles such as Ag, Ni, Cu, Fe or the like, for example. In such an embodiment, the carbonaceous filler may be carbon nanotubes ("CNT"s), carbon black, carbon nanofiber, graphene, expanded graphite, graphite nanoplatelet or graphite oxide ("GO"), or the like, for example. In an embodiment, the electroconductive filler 312*b* may have a form in which the above particles are coated with another conductive material. In an alternative embodiment, the electroconductive filler 312*b* may have a form in which the above particles are doped with another conductive material. In an embodiment, the electroconductive filler 312*b* may have various forms such as a fiber shape, a globular shape, and the like, for example.

The electroconductive filler 312*b* may be dispersed in the base polymer 312*a*, and form an electroconductive network. In one embodiment, for example, a conductor or a resistor having conductivity in a range of about $10^{-4}$ siemen per meter (S/m) to about 100 siemens per meter (S/m) may be provided depending on the amount of CNTs included therein. Referring to Table 1 below, CNTs have a relatively low density with a conductivity similar to conductivities of metals, and thus, CNTs have a thermal capacity (thermal capacity=density×specific heat) per unit volume that is about 3 to 4 times lower than thermal capacities of other resistive materials. In an embodiment, the resistive heating layer 312 includes CNTs as the electroconductive filler 312*b* such that rapid temperature change occurs therein. In such an embodiment, the heating member 310 includes the resistive heating layer 312 containing the electroconductive filler 312*b* such that the time taken from a standby mode to a printing mode is substantially reduced, thereby effectively preforming rapid printing. In such an embodiment, preheating of the heating member 310 in the standby mode may be omitted, and thus power consumption is substantially reduced.

TABLE 1

| Resistive material | Density ($g/cm^3$) | Specific resistance (Ω cm) | Thermal conductivity (W/m·K) | Specific heat (J/Kg · K) |
|---|---|---|---|---|
| $Al_2O_3$ | 3.97 | $>10^{14}$ | 36 | 765 |
| AlN | 3.26 | $>10^{14}$ | 140~180 | 740 |
| Stainless steel | 7.8 | $>10^{-5}$ | 55 | 460 |
| polydimethylsiloxane (PDMS) | 1.03 | $>10^{14}$ | 0.18 | 1460 |
| CNTs | ~1.35 | $\sim10^{-3}\sim10^{-4}$ | >3000 | 700 |
| Nichrome wire | 8.4 | $1.09 \times 10^{-4}$ | 11.3 | 450 |

In an embodiment, the release layer 313 defines an outermost layer of the heating member 310. In a fusing process, toner on the recording medium P may melt and adhere to the heating member 310, thereby causing an offset. This offset may cause partial loss of a printed image on the recording medium P, and a jam of the recording medium P, e.g., sticking of the recording medium P traveling out of the fusing nip 301 to a surface of the heating member 310. In an embodiment, the release layer 313 may include an efficiently releasable polymer layer such that toner is effectively prevented from being adhered to the heating member 310. In an embodiment, the release layer 313 may include, for example, a silicon-based polymer or a fluoropolymer. In such an embodiment, the fluoropolymer includes polyperfluoroethers, fluorinated polyethers, fluorinated polyimides, fluorinated PEEK, fluorinated polyamides and fluorinated polyesters, for example. The release layer 313 may include one of the above-listed polymers, a blend of at least two thereof, or a copolymer of at least two thereof.

Figure 6:
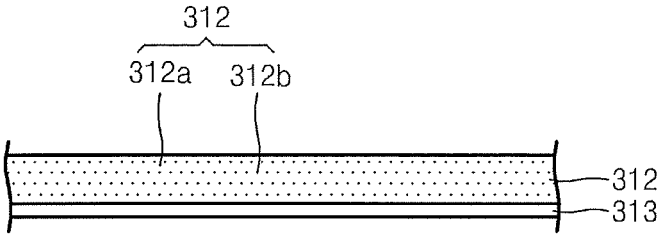
FIG. 6 is a partial cross-sectional view of an alternative embodiment of the heating member in the belt-type fusing apparatus of FIG. 4.

In an embodiment, where the base polymer 312*a* of the resistive heating layer 312 includes a fluoropolymer, the release layer 313 may be omitted, and thus, the resistive heating layer 312 may be an outermost layer of the heating ember 310. In an embodiment, where the base polymer 312*a* of the resistive heating layer 312 includes polyimide, as illustrated in FIG. 6, the belt-type heating member 310 may have a structure, in which the support 311 is omitted.

The resistive heating layer 312 receives a mechanical load, such as a pressure applied when forming the fusing nip 301 with the press member 320, torque due to the rotation of the press member 320, resistive force due to an alignment error between the heating member 310 and the press member 320, or the like, and a thermal load occurring while heating the fusing apparatus 300 to the fusing temperature. The mechanical and thermal loads cause mechanical and thermal deformation of the resistive heating layer 312, thereby changing the resistance of the resistive heating layer 312. The change in the resistance of the resistive heating layer 312 due to the mechanical and thermal deformation may be represented by the following Equation 1.

$$\frac{dR}{R} = \left[\frac{dR}{R}\right]d\varepsilon + \left[\frac{dR}{R}\right]dT = \left[\frac{1}{L}\frac{\partial L}{\partial \varepsilon} - \frac{1}{A}\frac{\partial A}{\partial \varepsilon} - \frac{1}{s}\frac{\partial s}{\partial \varepsilon}\right] d\varepsilon + \left[\frac{1}{L}\frac{\partial L}{\partial T} - \frac{1}{A}\frac{\partial A}{\partial T} - \frac{1}{s}\frac{\partial s}{\partial T}\right]dT \quad (1)$$

In Equation 1, R, $\epsilon$, L, A, s, and T denote the resistance, deformation rate, length, cross-sectional area, electric conductivity and temperature of the resistive heating layer 312, respectively.

When the resistive heating layer 312 is driven by a constant voltage (V), an input power input to the resistive heating layer 312 may be given by the expression $V^2/R$. When the resistance (R) of the resistive heating layer 312 is changed due to the mechanical and thermal deformation, the input power is changed. If the resistance (R) of the resistive heating layer 312 gradually decreases in the heating process, the input power gradually increases. If the resistance (R) of the resistive heating layer 312 gradually increases in the heating process, the input power gradually decreases. In an embodiment, the input power is substantially limited such that overheating of the resistive heating layer 312 in the heating process, which may occur due to an excessive current flowing when the resistance (R) of the resistive heating layer 312 decreases, is effectively prevented. The excessive current may cause a thermal shock in the base polymer 312*a*, and thus may deteriorate the durability of the resistive heating layer 312, thereby increasing the risk of fire due to the overheating.

Accordingly, in an embodiment, a maximum input power is set not to overheat the resistive heating layer 312, based on the lowest value of the resistance (R) of the resistive heating layer 312. In such an embodiment, the maximum input power is lowered when the resistance change rate of the resistive heating layer 312 is relatively high, to effectively prevent the overheating, and thus a heating time may be increased.

The change in the resistance of the resistive heating layer 312 may be reduced to a predetermined level to effectively prevent the overheating and to shorten the heating time. In an embodiment, the resistance change rate of the resistive heating layer 312 in the heating process is about 100 percent or less. When the resistance of the resistive heating layer 312 at room temperature is $R_0$, and the resistance of the resistive heating layer 312 at a fusing temperature is $R_F$, the resistance change rate in the heating process satisfies the following In equation 2.

$$\frac{R_F - R_0}{R_0} \times 100(\%) \leq 100(\%) \quad (2)$$

First and second resistance changes due to a compressive force and a tension force, which affect the resistive heating layer 312 while the fusing apparatus 300 is driven and heated, may be represented by the following Equations 3 and 4, respectively.

$$\frac{dR}{R} = \varepsilon_p + \frac{ds}{s} \quad (3)$$

$$\frac{dR}{R} = \varepsilon_t(1 + v) + \frac{ds}{s} \quad (4)$$

$\epsilon_p$ denotes a deformation rate due to the compressive force, $\epsilon_t$ denotes a deformation rate due to the tension force, and v denotes a Poisson's ratio.

The first term on the right side of each of Equations 3 and 4 indicates a mechanical deformation, and the change in the resistance of the resistive heating layer 312 increases substantially proportional to the mechanical deformation. Accordingly, a mechanical stiffness of the resistive heating layer 312 may be raised to reduce the resistance change.

The second term on the right side of each of Equations 3 and 4 indicates an energy that is lost due to a change in electric conductivity, which may occur due to a change of a conductive network that is formed by the electroconductive filler 312*b* dispersed in the base polymer 312*a*. The change of the conductive network is dependent on a joining strength of the interface between the electroconductive filler 312*b* and the base polymer 312*a*, for example, an interaction between the electroconductive fillers 312*b*, such as a Van der Waals force or a mechanical interlocking between the electroconductive fillers 312*b*. When the lost energy is reduced, the resistance change of the resistive heating layer 312 is reduced.

The heating member 310 repeatedly receives a dynamic load during the fusing process. A mechanical stiffness and energy loss under the dynamic load may be represented by a storage modulus and a loss modulus. The mechanical stiffness and the energy loss under a dynamic load that is periodically applied may be measured through a dynamic mechanical analysis ("DMA").

When the resistive heating layer 312 has a linear viscoelastic behavior during the fusing process, a deformation rate ($\epsilon$) and a stress ($\sigma$) may be represented by the following Equations 5 and 6. $\delta_{poly}$ denotes a phase difference due to the base polymer 312*a*, $\delta_{part\text{-}part}$ denotes a phase difference due to an interaction between the electroconductive fillers 312*b*, $\delta_{part\text{-}poly}$ denotes a phase difference due to an interaction between the base polymer 312*a* and the electroconductive filler 312*b*, and $\delta_c$ is obtained by adding $\delta_{poly}$, $\delta_{part\text{-}part}$ and $\delta_{part\text{-}poly}$.

$$\varepsilon = \varepsilon_0 \sin\omega t \tag{5}$$

$$\begin{aligned}\sigma &= \sigma_0 \sin(\omega t + \delta_{poly} + \delta_{part\text{-}part} + \delta_{part\text{-}poly}) \\ &= \delta_0 \sin(\omega t + \delta_{poly} + \delta_{part}) \\ &= \delta_0 \sin(\omega t + \delta_c) \\ &= \frac{\sigma_0}{\varepsilon_0}(\varepsilon_0 \cos\delta_c \sin\omega t + \varepsilon_0 \sin\delta_c \cos\omega t)\end{aligned} \tag{6}$$

When the storage modulus ($E_c'$) satisfies the following Equation 7 and the loss modulus ($E_c''$) satisfies the following Equation 8, the stress ($\sigma$) may satisfy the following Equation 9.

$$E_c' = \frac{\sigma_0}{\varepsilon_0}\cos\delta_c \tag{7}$$

$$E_c'' = \frac{\sigma_0}{\varepsilon_0}\sin\delta_c \tag{8}$$

$$\sigma = E_c'\varepsilon_0 \sin(\omega t) + E_c''\varepsilon_0 \cos(\omega t) \tag{9}$$

The mechanical stiffness may be represented by the storage modulus ($E_c'$), and the energy loss may be represented by the following Equation 10 as a tangent loss ($\tan\delta_c$) that is a ratio of the loss modulus ($E_c''$) to the storage modulus ($E_c'$).

$$\tan\delta_c = \frac{E_c''}{E_c'} \tag{10}$$

As described above, when a mechanical deformation of the resistive heating layer 312 is reduced by increasing a mechanical stiffness of the resistive heating layer 312, the resistance change rate of the resistive heating layer 312 is lowered. In an embodiment, the storage modulus $E_c'$ may be set to be greater than a predetermined value. In one embodiment, for example, the storage modulus $E_c'$ may be about 1 megapascal (MPa) or greater at the fusing temperature.

As described above, when the energy loss is reduced, the resistance change rate of the resistive heating layer 312 is reduced. Accordingly, in an embodiment, the tangent loss ($\tan\delta_c$) may be about 0.2 or less at the fusing temperature.

In an embodiment of the fusing apparatus 300, a pressing force that is applied to the heating member 310 may be in a range from about 2 kilogram-force (Kgf) to about 20 kilogram-force (Kgf), and a width of the fusing nip 301 may be in a range from about 4 millimeters (mm) to about 10 millimeters (mm). Accordingly, in such an embodiment, an average pressure is in a range of about 0.00476 MPa to about 0.019 MPa. In such an embodiment, the relation between the storage modulus $E_c'$ and the transformation rate c is shown in Table 2. A general rubber is linearly deformed with respect to the storage modulus $E_c'$ in a section in which the deformation rate $\epsilon$ is about 5 percent or greater. Thus, in such an embodiment, the storage modulus $E_c'$ may be about 0.5 MPa or greater such that the deformation rate $\epsilon$ may be about 5 percent or less, thereby substantially reducing the resistance change.

TABLE 2

| Pressure | [kgf] | 2 | 20 |
|---|---|---|---|
| Width of fusing nip | [mm] | 4 | 10 |
| Length of fusing nip | [mm] | 210 | 210 |
| Average pressure | [MPa] | 0.00476 | 0.0194 |
| Storage modulus ($E_c'$) | [MPa] | Deformation rate ($\epsilon$) | |
| 0.1 | | 4.76 | 19.05 |
| 0.2 | | 2.38 | 9.52 |
| 0.3 | | 1.59 | 6.35 |
| 0.4 | | 1.19 | 4.76 |
| 0.5 | | 0.95 | 3.81 |
| 0.6 | | 0.79 | 3.17 |
| 0.7 | | 0.68 | 2.72 |
| 0.8 | | 0.6 | 2.38 |
| 0.9 | | 0.53 | 2.12 |
| 1 | | 0.48 | 1.9 |
| 2 | | 0.24 | 0.95 |
| 2.5 | | 0.19 | 0.76 |
| 3 | | 0.19 | 0.63 |
| 5 | | 0.1 | 0.38 |
| 6 | | 0.08 | 0.32 |
| 7 | | 0.07 | 0.27 |
| 13 | | 0.04 | 0.15 |

The resistance change of the resistive heating layer 312 was observed with respect to an embodiment of the heating member 310, prepared under the conditions below. The term "phr" indicating an amount of the electroconductive filler 312*b* is an abbreviation of "parts per hundred resin".

[Heating Member]

The support 311: a belt shape having a thickness of about 50 μm and an inner diameter of about 24 mm The base polymer 312*a*: polydimethylsiloxane ("PDMS") or dimethyl methyl vinyl siloxane ("DMMVS")

The electroconductive filler 312*b*: CNT having a diameter in a range of about 10 nanometers (nm) to about 15 nanometers (nm) and a length of about 10 μm.

An amount of the electroconductive filler 312*b*: 1, 4, 8, 13, 26 phr

The release layer 313: PFA layer having a thickness of about 30 μm

[Experimental Conditions]

The pressing force applied to each of both ends of the heating member 310: about 20 kgf The width of the fusing nip 301: about 10 mm Measurement conditions: a frequency of about 10 Hz and a fusing temperature of about 200° C.

A storage modulus measuring instrument: Q800 manufactured by TA Instruments® Co.

Figure 7:
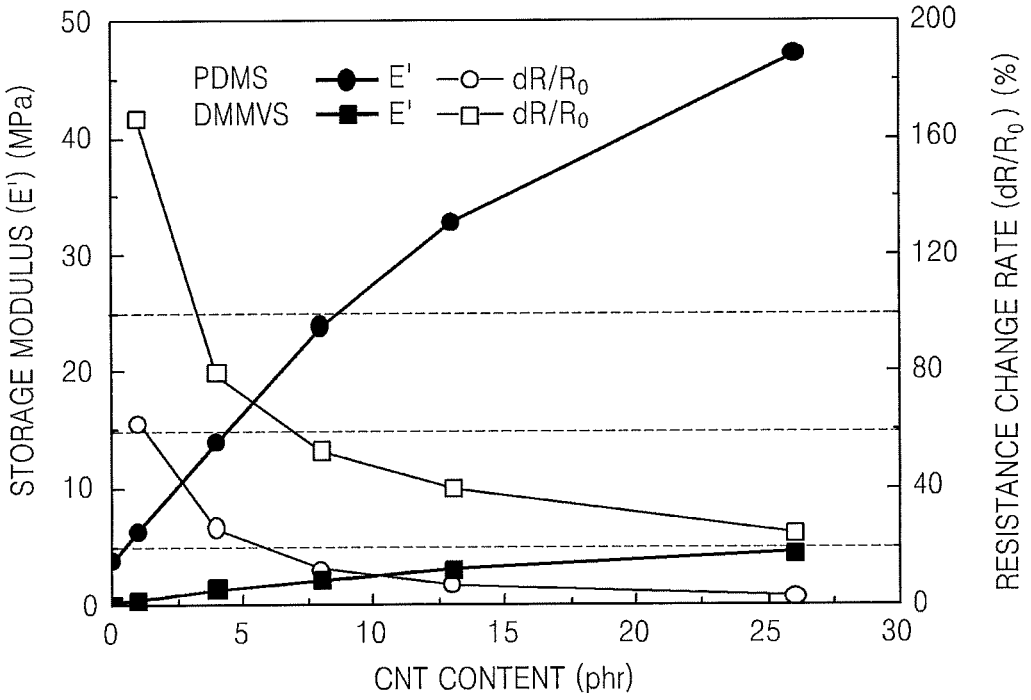
FIG. 7 is a graph illustrating a storage modulus (megapascal: MPa) and a resistance change rate (percent: %) of an embodiment of a resistive heating layer versus carbon nanotube ("CNT") content (part per hundred resin: phr)
Figure 8:
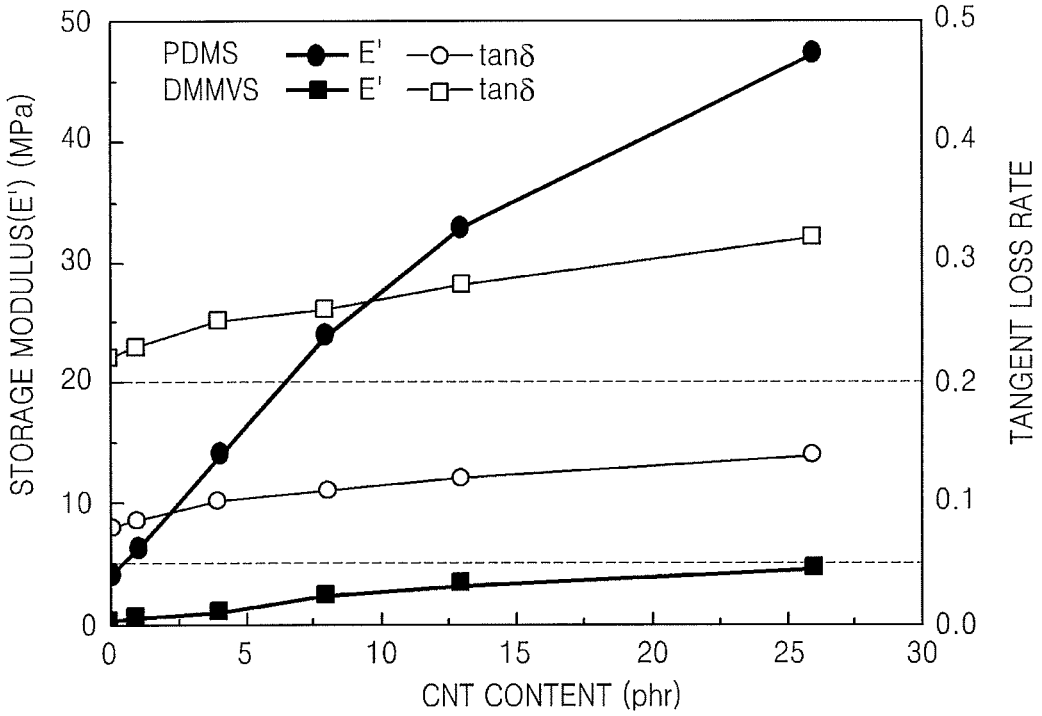
FIG. 8 is a graph illustrating a storage modulus (MPa) and tangent loss rate of an embodiment of the resistive heating layer versus CNT content (phr)

FIG. 7 is a graph illustrating a storage modulus (MPa) and a resistance change rate (%) of an embodiment of the resistive heating layer 312 versus CNT content (phr). FIG. 8 is a graph illustrating a storage modulus (MPa) and a tangent loss rate (%) of an embodiment of the resistive heating layer 312 versus CNT content (phr).

Referring to FIG. 7, the storage modulus increases as the CNT content increases, but the resistance of the resistive heating layer 312 substantially exponentially decreases as a conductive network in the base polymer 312*a* is substantially rapidly increased when the CNT content becomes higher. When the CNT content is about 1 phr, the resistance change rate of a CNT/PDMS combination is about 62% and the resistance change rate of a CNT/DMMVS combination is about 167%. As shown in FIG. 7, the resistance change rate of the CNT/PDMS combination and the resistance change rate of the CNT/DMMVS combination are rapidly lowered as the CNT content is increased. In an embodiment, where the resistance change rate for effectively controlling the fusing temperature of the fusing apparatus 300 is about 100 or less, the resistive heating layer of the fusing apparatus 300 may have the CNT content of about 4 phr or greater and the storage modulus of about 1 MPa or greater.

Referring to FIG. 8, the tangent loss rate is increased as the CNT content is increased. The CNT/DMMVS combination has a relatively high tangent loss rate compared to the CNT/PDMS combination. When the tangent loss rate is high, the energy loss may increase during deformation, and the energy loss occurs between polymer and polymer, between polymer and CNT, and between CNT and CNT. In an embodiment, the resistance change rate may be lowered using polymer having a substantially low tangent loss rate as the resistive heating layer 312.

Figure 9:
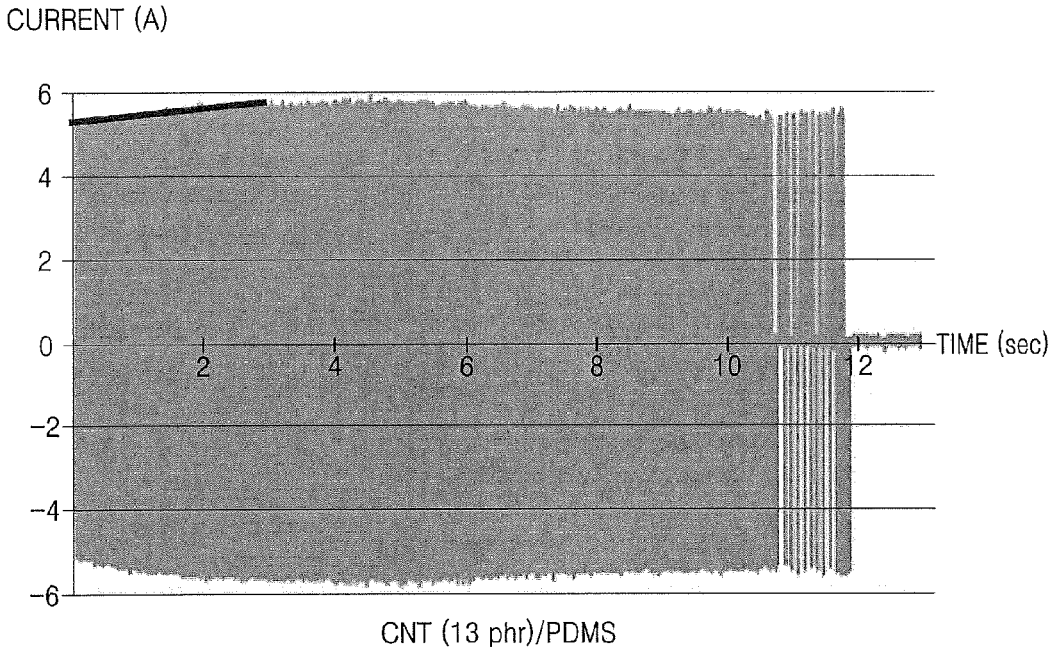
FIG. 9 is a graph illustrating a current variation of a CNT(13 phr)/polydimethylsiloxane ("PDMS") combination during heating.
Figure 10:
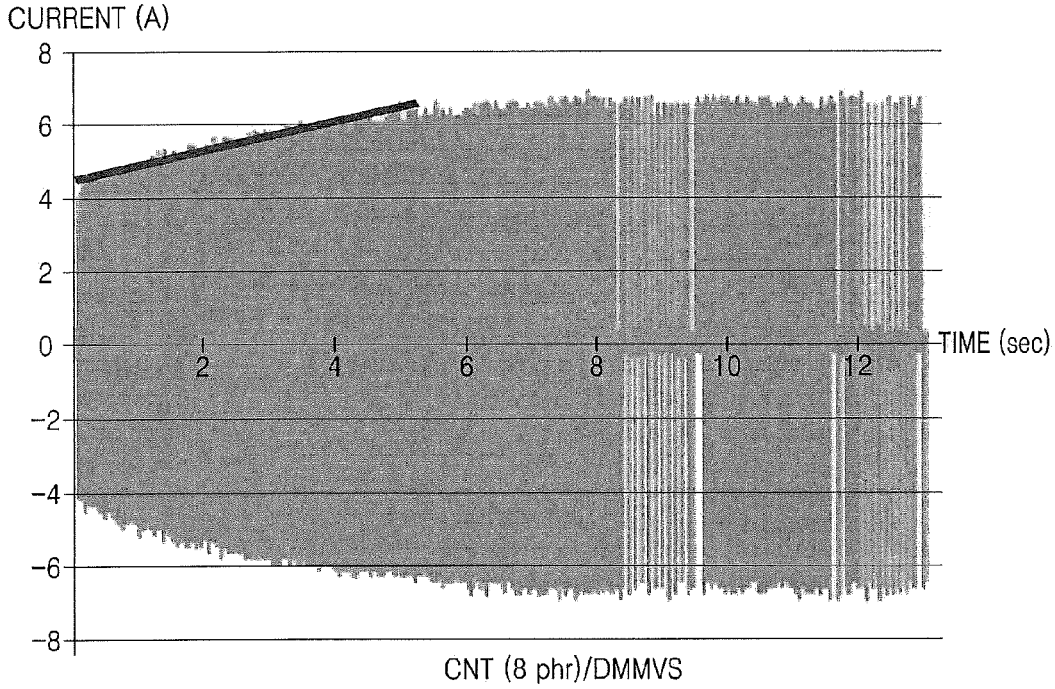
FIG. 10 is a graph illustrating a current variation of a CNT(8 phr)/dimethyl methyl vinyl siloxane ("DMMVS") combination during heating.

FIG. 9 is a graph illustrating a current variation of an embodiment of a heating member including a CNT(13 phr)/PDMS combination during heating in the above experiment. FIG. 10 is a graph illustrating a current variation of an embodiment of a heating member including a CNT(8 phr)/DMMVS combination during heating in the above experiment. Referring to FIGS. 9 and 10, since the resistance change is substantially proportional to the variation of current, an embodiment including the CNT(13 phr)/PDMS combination shows a resistance change rate of about 7 percent, and an embodiment including the CNT(8 phr)/DMMVS combination shows a resistance change rate of about 53%. As described above, the resistance change rate of each of an embodiment including the CNT(13 phr)/PDMS combination and an embodiment including the CNT(8 phr)/DMMVS combination is 100 percent or less. Also, at the same pressing force and fusing temperature, the higher the storage modulus is, the smaller the resistance change rate is.

The exemplary experiment described above is performed under conditions of the fusing apparatus 300 (that is, the fusing temperature of about 200° C. and the pressing force of about 20 kgf), which are applied to a printing speed of about 70 pages per minute (ppm) or greater. The above experiment may be identically applied also under different conditions of the fusing apparatus 300, for example, a fusing temperature in a range of about 120° C. to about 200° C. and a pressing force of about 2 kgf, which are applied to a printing speed lower than about 70 ppm.

Accordingly, in an embodiment, the resistive heating layer 312 includes polymer material, and the resistance change rate of 100 percent or less may be obtained using the polymer material, the storage modulus $E_c'$ of which is about 1 MPa or greater at the fusing temperature of about 120° C. or greater, for example, from 120° C. to 200° C. In such an embodiment, the resistive heating layer 312 may include a polymer material having a tangent loss of about 0.2 or less such that a relatively low resistance change rate is obtained.

Although a silicon rubber is used as the base polymer 312*a* in an embodiment used in the experiment, the scope of the invention is not limited thereto. In an embodiment, when the storage modulus is about 1 MPa or greater and heat resistance characteristics satisfies the conditions described above at the fusing temperature, another polymer material other than the silicon rubber may be used.

When CNT is used as the electroconductive filler 312*b*, CNT content may be about 100 wt % or less. The larger the CNT content in the resistive heating layer 312 is, the more the electric conductivity of the resistive heating layer 312 is improved, but the resistive heating layer 312 may become substantially stiff. As the resistive heating layer 312 forms the fusing nip 301 with the press member 320, the size of the fusing nip may be decreased if the resistive heating layer 312 becomes substantially stiff. If the resistive heating layer 312 has a relatively high stiffness, mechanical characteristics thereof may be deteriorated, and thus the heating member 310 may have a relatively short lifespan. In an embodiment, the CNT content may be about 100 wt % or less.

If the length of the CNT is short, a change of an electric conductive network is relatively large due to a compressive deformation and tensile deformation of the resistive heating layer 312 during the fusing process, and thus, the energy loss may become relatively high. In an embodiment, the electroconductive filler 312*b* includes CNT having the length of about 10 μm or greater may such that the change of the electric conductive network is substantially reduced.

As described above, although the one or more of the above embodiments of the invention are described with reference to the use of a heating member in a fusing apparatus of an electrophotographic imaging apparatus, the application of the heating member is not limited only to the fusing apparatus, and for example, the heating member may be applied to any of a variety of apparatuses generating heat from electricity.

It should be understood that the embodiments described therein should be considered in a descriptive sense only and not for purposes of limitation. Descriptions of features or aspects within each embodiment should typically be considered as available for other similar features or aspects in other embodiments.

What is claimed is:

1. A heating member for a fusing apparatus that is configured to oppose to a press member to define a fusing nip therebetween and rotate together with the press member, the heating member comprising:

a resistive heating layer; and a release layer defining an outermost layer of the heating member, wherein the resistive heating layer includes:

a base polymer, and an electroconductive filler dispersed in the base polymer to form an electroconductive network such that the resistive heating layer is configured to generate heat by applying a constant voltage to the resistive heating layer to fix toner image on a recording medium while the recording medium on which the toner image is transferred passes through the fusing nip, wherein a storage modulus of the resistive heating layer is about 1.0 megapascal or greater.

2. The heating member of claim 1, wherein a tangent loss rate of the resistive heating layer is about 0.2 or less.

3. The heating member of claim 1, wherein the storage modulus of the resistive heating layer is about 1.0 megapascal or greater at a temperature of about 120° C. or greater, and a tangent loss rate of the resistive heating layer is about 0.2 or less at a temperature of about 120° C. or greater.

4. The heating member of claim 1, wherein the base polymer comprises at least one of silicon, polyimide, polyimideamide and fluoropolymer.

5. The heating member of claim 1, wherein the electroconductive filler comprises a carbonaceous filler.

6. The heating member of claim 5, wherein the carbonaceous filler comprises at least one of carbon nanotube, carbon black, carbon nanofiber, graphene, expanded graphite, graphite nanoplatelet and graphite oxide.

7. The heating member of claim 6, wherein the electroconductive filler comprises carbon nanotube at an amount of about 4 parts per hundred resin or greater.

8. The heating member of claim 7, wherein a length of the carbon nanotube is about 10 micrometers or greater.

9. The heating member of claim 1, further comprising:

a hollow pipe-shaped support which supports the resistive heating layer.

10. The heating member of claim 1, further comprising:

a belt-shaped support which supports the resistive heating layer.

11. The heating member of claim 1, wherein a resistance change rate of the resistive heating layer is expressed by $[(R_F-R_0)/R_0]\times100$ percent, wherein $R_0$ denotes a resistance of the resistive heating layer at room temperature, and $R_F$ denotes a resistance of the resistive heating layer at a fusing temperature, and the resistance change rate of the resistive heating layer is about 100 percent or less.

12. The heating member of claim 1, wherein the constant voltage is a voltage determined based on a lowest resistance value of the resistive heating layer such that a maximum input power input to the resistive heating layer is set not to overheat the resistive heating layer.

13. A fusing apparatus comprising:

the heating member of claim 1; and a press member disposed opposite to the heating member, wherein the press member and the heating member define a fusing nip.

14. The fusing apparatus of claim 13, wherein a tangent loss rate of the resistive heating layer is about 0.2 or less.

15. The fusing apparatus of claim 13, wherein the storage modulus of the resistive heating layer is about 1.0 megapascal or greater at a temperature of about 120° C. or greater, and a tangent loss rate of the resistive heating layer is about 0.2 or less at a temperature of about 120° C. or greater.

16. The fusing apparatus of claim 13, wherein the base polymer comprises at least one of silicon, polyimide, polyimideamide and fluoropolymer.

17. The fusing apparatus of claim 13, wherein the electroconductive filler comprises a carbonaceous filler.

18. The fusing apparatus of claim 17, wherein the electroconductive filler comprises carbon nanotube at an amount of about 4parts per hundred resin or greater.

19. The fusing apparatus of claim 18, wherein a length of the carbon nanotube is about 10 micrometers or greater.

20. The fusing apparatus of claim 13, further comprising:

a support which supports the resistive heating layer, wherein the support has a hollow pipe shape or a belt shape.

21. The fusing apparatus of claim 13, wherein a resistance change rate of the resistive heating layer is expressed by $[(R_F-R_0)/R_0]\times100$ percent, wherein $R_0$ denotes a resistance of the resistive heating layer at room temperature, and $R_F$ denotes a resistance of the resistive heating layer at a fusing temperature, and the resistance change rate of the resistive heating layer is about 100 percent or less.

* * * * *